United States Patent [19]

van der Zanden

[11] Patent Number: 4,979,552

[45] Date of Patent: Dec. 25, 1990

[54] MULTIPLE GLAZED WINDOW UNIT

[75] Inventor: George C. van der Zanden, Delft, Netherlands

[73] Assignee: Hunter Douglas International N.V., Curacao, Netherlands Antilles

[21] Appl. No.: 353,118

[22] Filed: May 17, 1989

[30] Foreign Application Priority Data

Jun. 3, 1988 [GB] United Kingdom ..... 8813092

[51] Int. Cl.[5] ..... E06B 9/264

[52] U.S. Cl. ..... 160/107; 160/176.1; 160/DIG. 17; 49/64

[58] Field of Search ..... 160/107, 98, 176.1, 160/310, 381, DIG. 17; 49/64

[56] References Cited

U.S. PATENT DOCUMENTS

| | | | |
|---|---|---|---|
| 3,181,595 | 5/1965 | Pender | 160/171 |
| 3,468,360 | 9/1969 | Payne | 160/176.1 X |
| 4,096,903 | 6/1978 | Ringle | 160/107 X |
| 4,503,900 | 3/1985 | Osaka et al. | 160/107 X |
| 4,586,289 | 5/1986 | Jaeger | 160/107 X |
| 4,602,456 | 7/1986 | Tatro | 160/107 X |
| 4,664,169 | 5/1987 | Osaka et al. | 160/107 |
| 4,685,502 | 8/1987 | Spangenberg | 160/107 |
| 4,723,586 | 2/1988 | Spangenberg | 160/107 |

FOREIGN PATENT DOCUMENTS

| | | |
|---|---|---|
| 853956 | 10/1970 | Canada . |
| 0154218 | 9/1985 | European Pat. Off. . |
| 0245811 | 11/1987 | European Pat. Off. . |
| 1906990 | 3/1970 | Fed. Rep. of Germany . |

*Primary Examiner*—David M. Purol

*Attorney, Agent, or Firm*—Pennie & Edmonds

[57] ABSTRACT

A multiple glazed window unit and venetian blind assembly in which a rectangular glass spacer frame has at least one of its upper and lower frame members connected to at least one of the side frame members by at least one electric motor unit, each motor unit including a housing and an electric motor, the housing being connected, to one of the horizontal frame members and one of the side frame members, so that the housing forms a corner of and a structural part of the frame. The electric motor is used to operate a venetian blind mounted between the panes of glass carried by the glass spacer frame.

9 Claims, 4 Drawing Sheets

MULTIPLE GLAZED WINDOW UNIT

BACKGROUND OF THE INVENTION

1. Field of the Invention

The present invention relates to a multiple glazed window unit and venetian blind assembly and more particularly such an assembly operated by an electric motor.

2. Description of Related Art

It is has been quite common recently to mount a venetian blind in the space between panes of a double glazed window or between two of the panes of a multiple glazed window. Because the venetian blind itself is fully sealed within the space, which itself is hermetically sealed both from the exterior and the interior of the room to which the assembly is mounted, control of the blind is quite difficult. One way to achieve this is to provide a magnetic operation in which an actuating member is mounted on the room side of the inner pane which co-operates with an operating member in the space between the panes. Another proposal has been to mount an electric motor in the space between the panes but considerable difficulty has been experienced in this latter proposal in supplying current to the motor for power and/or to control of the motor. The problem is that electrical conductors for this purpose must be introduced into the interior of the space in a hermetically sealed manner. The first option is to bore a hole through the glass pane for this purpose, but this produces undesired stresses in the adjacent area of the glass which can lead to cracking of the pane and the second option is to form a bore in the frame of the glass. This is disadvantageous because it positions the electrical connection in a concealed and difficult to reach position.

SUMMARY OF THE INVENTION

It is now proposed, according to the present invention, to provide a multiple glazed window unit and venetian blind assembly comprising a rectangular glass spacer frame, having upper and lower horizontal frame members and two side frame members, at least two panes of glass spaced from one another by said frame and including an inner pane and an outer pane defining with the frame a space therebetween, edge portions of the panes of glass being secured to or held in contact with said frame, a venetian blind situated in said space and attached to opposite frame members, at least one electric motor unit, including a housing and an electric motor mounted in the housing, the housing being connected to one of said horizontal frame members and one of said side frame members, whereby said housing forms a corner of and a structural part of said frame and drive means protruding through an opening to the inside of the space connecting said blind to said motor, whereby the blind can be operated by the motor.

With such a construction, the electric motor unit can be very compactly and readily positioned during the course of assembly of the frame members, and rather than weaken the frame, they can be used as a structural part which generally strengthens the frame, while still providing the motorizing facility.

Preferably the frame member has a contoured cross-section and said motor unit housing includes two tongues extending perpendicular to one another, said tongues being engaged in said contoured cross-section to secure the or each housing to two frame members and thereby form said corner of the frame.

Such a structure makes assembly of the frame together with the motor unit very simple.

At least one of the frame members may be cut away to accommodate the motor housing and the electric motor unit may include a gear train to provide a reduced speed drive to the drive means, this, for example, being in the form of one or more pairs of intermediary spur gears or a worm mounted on the motor shaft and a wormwheel connected to the drive means.

BRIEF DESCRIPTION OF THE DRAWING

In order that the invention may more readily be understood, the following description is given, merely by way of example, reference being made to the accompanying drawings, in which.

DETAILED DESCRIPTION OF THE INVENTION

Figure 1:
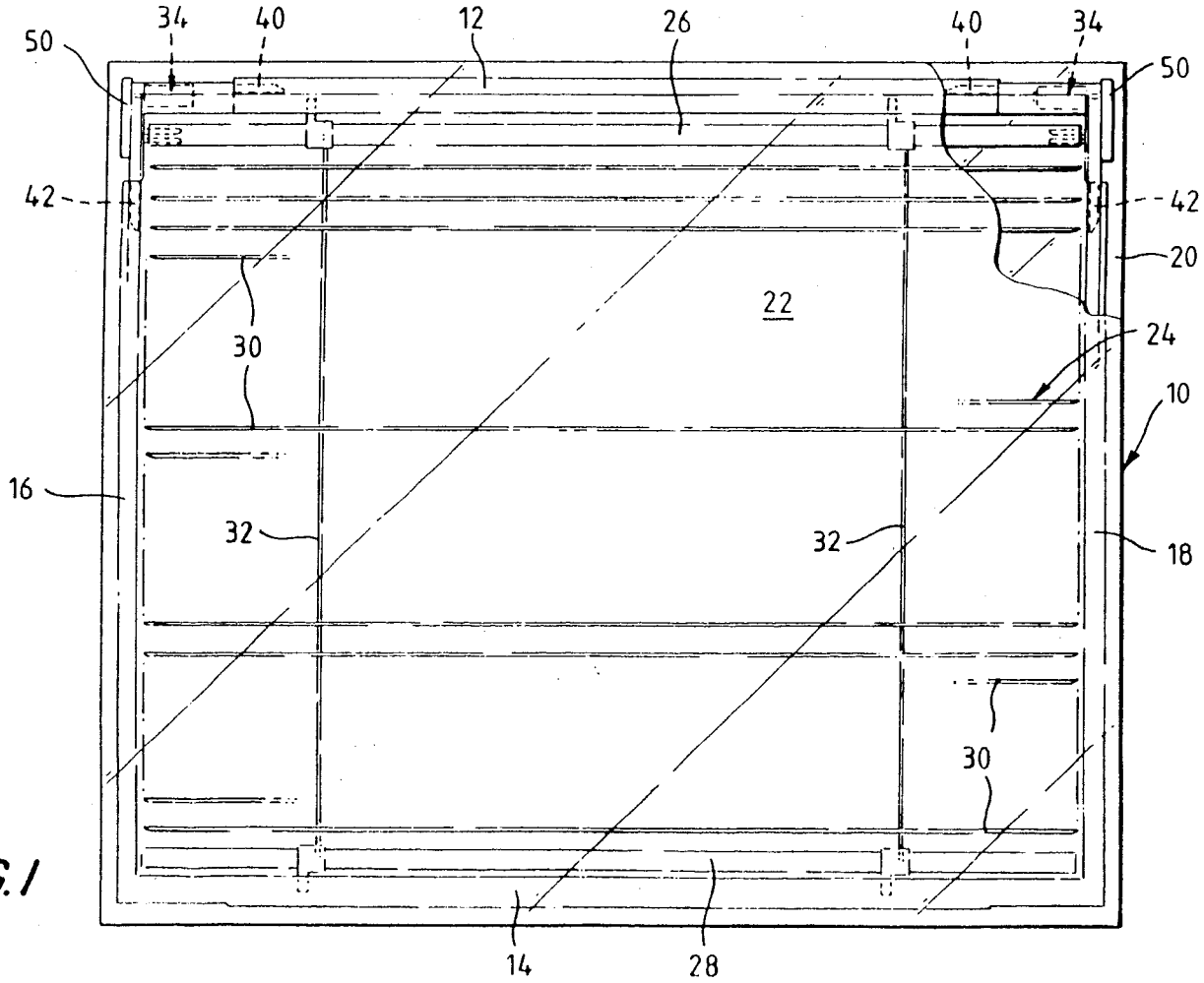
FIG. 1 is a front view of one embodiment of assembly according to the invention.

The unit illustrated in FIG. 1 of the drawing comprises a frame with the general reference numeral 10 comprising an upper horizontal spacer frame member 12, a lower horizontal spacer frame member 14 and left and right side spacer members 16 and 18. These are used to space two panes of glass 20, 22 in a conventional way to provide a double-glazed unit. A venetian blind 24 is mounted in the space between the panes 20 and 22 and includes an upper support member 26 and a lower support member 28 carried by the upper and lower spacer frame members 12 and 14 respectively and are usually mounted so as to be tensioned with respect to one another. The venetian blind includes the conventional slats 30 and ladders 32 extending between the upper and lower supports 26 and 28. The upper and lower side frame members 12, 14, 16, 18 are connected together at their corners by suitable corner members. According to the present invention, at least one of these corner members comprises an electric motor unit 34. This motor unit includes a housing 36 in which is mounted an electric motor 38. The housing 36 includes two tongues 40, 42, these being engaged in the end of the upper spacer frame 12 and the side frame 18 to form a corner unit. It will be seen that the frame members 12, 18 each have a contoured cross-section at 13, 19, enabling the tongues 40,42, which extend perpendicularly to one another to be engaged securely in the contoured cross-section, to secure housing 36 to the upper frame member 12 and the side frame member 18, thereby forming the corner of the frame as a structural part of the frame.

The electric motor unit 34 has associated with the electric motor 38 a gear train 44 which is illustrated as including one or more pairs of intermediary spur gears 46. The final drive from the spur gears 46 is shown as a drive connection 48 which is connected to the upper support 26 as shown in FIG. 1.

Figure 2:
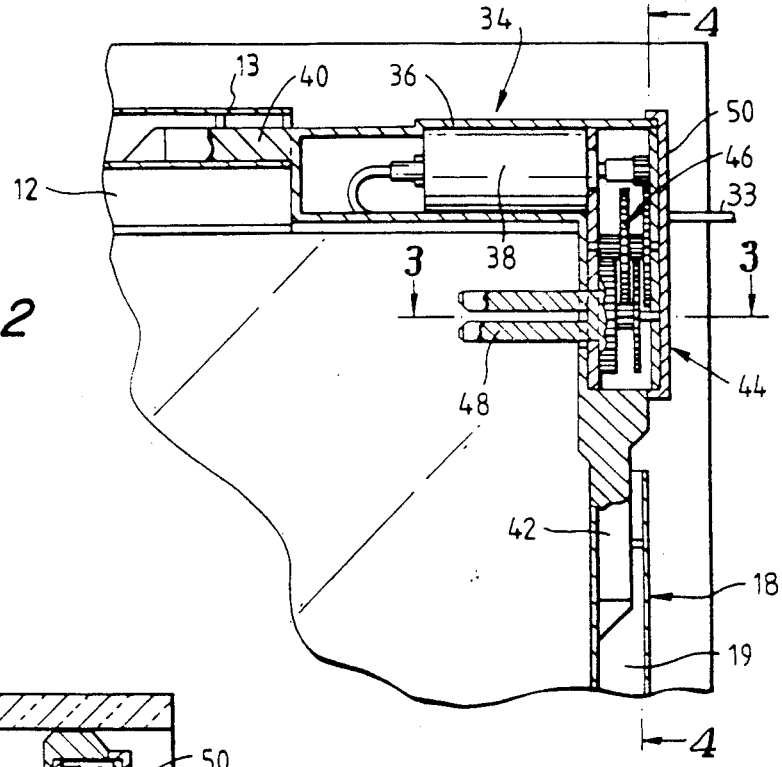
FIG. 2 is a fragmentary cross-section through a corner portion of the frame of the assembly of FIG. 1.
Figure 3:
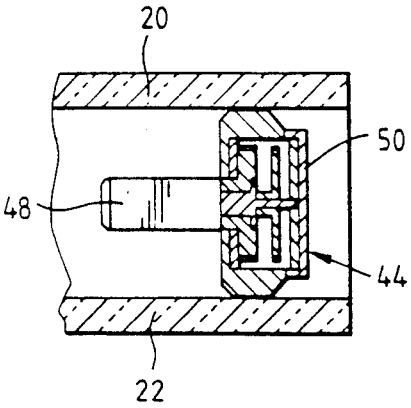
FIG. 3 is a section taken along the line III—III of FIG. 2.
Figure 4:
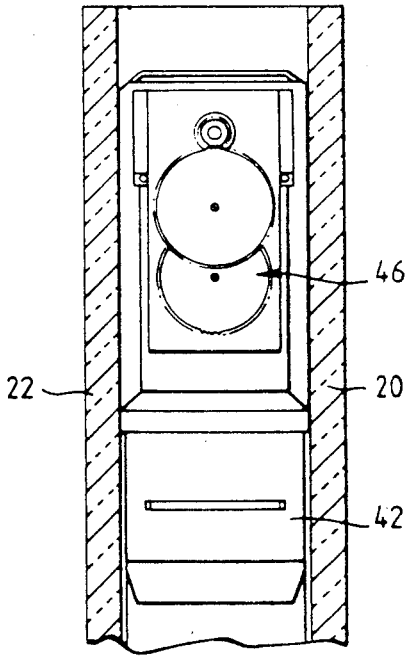
FIG. 4 is a section taken along the line IV—IV of FIG. 2.

Suitable electric connections to the motor can be provided by electric leads 33 which pass along the exterior of one of the frame members to a source of electricity. The motor unit may, in fact, be relatively inexpensive low voltage DC electric motors which can be arranged to be controlled in any suitable manner. As shown in FIG. 2 the main part of the housing 36 is closed by a cover 50. As illustrated in FIG. 1, two such motor units 34 are provided, one on each side of the frame and these are used simply to tilt the blind. It is also contemplated that one or more of the motor units may be used to operate a lift mechanism to enable the blinds to be lifted.

Figure 7:
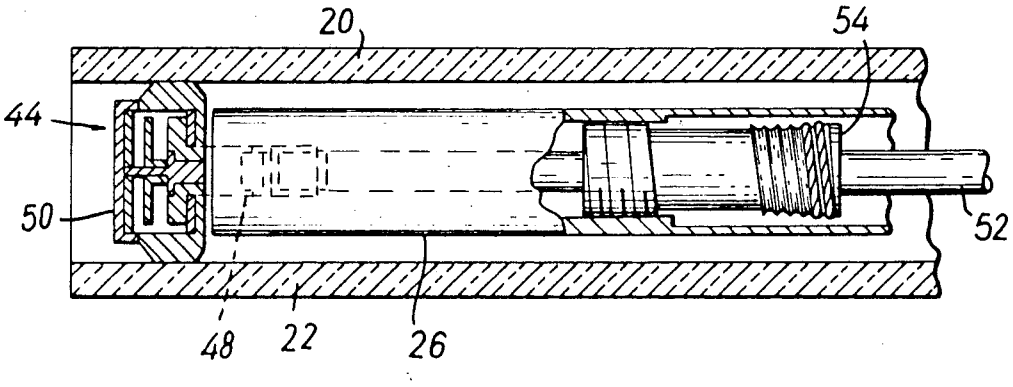
FIG. 7 is a top section view of the left corner of FIG. 1, similar to FIG. 3.

A variety of known left mechanisms are suitable for attachment to an electric motor for use with the present invention. For example, U.S. Pat. No. 3,181,595 shows one such mechanism. FIG. 7 illustrates such a lift mechanism 54 in use with the present invention. The lift mechanism 54 is mounted within the upper support member 26 slideably on a drive spindle 52 which is attached to one of the drive connections 48. The assembly and operation of such a lift mechanism will be readily apparent to one of ordinary and reasonable skill in the art.

While spur gears have been illustrated, it is also contemplated that a suitable worm drive be provided to enable the power to be transmitted from the motor, which can operate at a relatively high rotational speed to provide the tilt motion.

Figure 5:
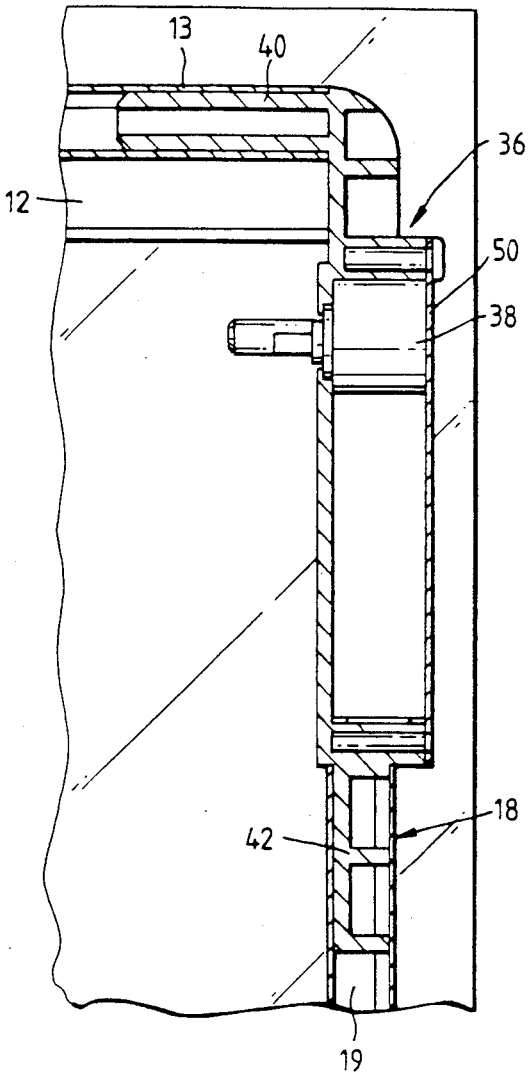
FIG. 5 is a view similar to FIG. 2 of a second embodiment.
Figure 6:
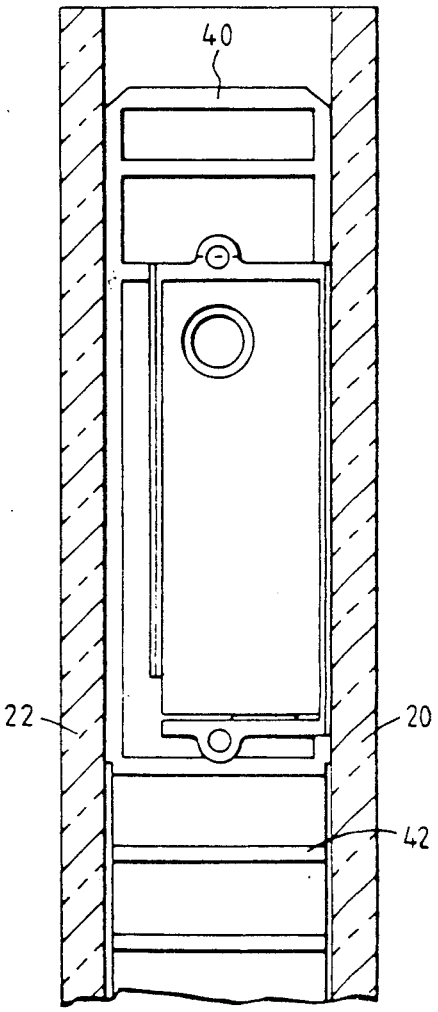
FIG. 6 is a view similar to FIG. 4 of the construction of FIG. 5.

The structure shown in FIGS. 5 and 6 is generally similar but a somewhat different format of the motor housing is shown. Like parts have been indicated by like reference numerals for simplicity and you will see that in this construction the housing 36 is of a somewhat different shape and that the upper tongue 40 is shown as an L-shaped member formed integrally with the housing and the lower tongue 42 extends perpendicular thereto. Again, the tongues 40, 42 are inserted into the end of the generally box cross-section profiled portion 13 of the upper frame member 12 and of the end of the similarly profiled portion 19 of the side frame member 18.

It will be seen that in the construction of FIGS. 1 to 4, the profiled portions 13 and 19 are both cut away to accommodate the motor housing, while in the structure of FIGS. 5 and 6 only portion of the profiled contour 19 of the side frame member 18 is cut away.

I claim:

1. A multiple glazed window unit and venetian blind assembly comprising a rectangular glass spacer frame having upper and lower horizontal frame members and two side frame members, at least two panes of glass spaced from one another by said frame and including an inner pane and an outer pane defining with the frame a space therebetween, edge portions of the panes of glass being secured to or held in contact with said frame, a venetian blind situated in said space and attached to the side frame members, at least one electric motor unit including a housing and an electric motor having an electrical lead mounted in the housing, the housing being connected to one of said horizontal frame members and one of said side frame members, said housing defining an opening, and a drive means protruding through the opening to the inside of the space connecting said blind to said motor, whereby said housing forms a corner of and a structural part of said frame and further whereby the blind can be operated by the motor.

2. An assembly according to claim 1, wherein said frame members have a contoured cross-section and wherein said motor unit housing includes two tongues extending perpendicular to one another, said tongues being engaged in said contoured cross-section to secure the housing to two frame members and thereby form said corner of the frame.

3. An assembly according to claim 2, wherein at least one of said frame members is cut away to accommodate said motor housing.

4. An assembly according to claim 1, 2 or 3, wherein said electric motor unit includes a gear train to provide a reduced speed drive to said drive means.

5. An assembly according to claim 4, wherein said gear train includes at least one pair of intermediary spur gears.

6. An assembly according to claim 4, wherein said gear train includes a worm mounted on the motor shaft and a wormwheel connected to the drive means.

7. An assembly according to claims 1, 2 or 3, wherein the electrical lead to the motor is passed along the exterior of one of the frame members.

8. An assembly according to claim 1, 2 or 3 and including two electric motor units, mounted in separate corners of the frame.

9. An assembly according to claim 8, wherein one motor unit is connected to operate a lift mechanism of the blind and the other motor unit is connected to operate a tilt mechanism of the blind.

* * * * *